US011032649B2

(12) United States Patent
Shao et al.

(10) Patent No.: US 11,032,649 B2
(45) Date of Patent: Jun. 8, 2021

(54) SPEAKER MODULE AND METHOD FOR MANUFACTURING SAME

(71) Applicant: AAC Technologies Pte. Ltd., Singapore (SG)

(72) Inventors: Yi Shao, Shenzhen (CN); Fan Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/727,967

(22) Filed: Dec. 27, 2019

(65) Prior Publication Data

US 2020/0288249 A1 Sep. 10, 2020

(30) Foreign Application Priority Data

Mar. 5, 2019 (CN) ..... 201910164167.4

(51) Int. Cl.

| | |
|---|---|
| ***H04R 1/02*** | (2006.01) |
| ***H04R 9/06*** | (2006.01) |
| ***H04R 9/02*** | (2006.01) |
| ***H04R 7/12*** | (2006.01) |
| ***H04R 7/18*** | (2006.01) |
| ***H04R 31/00*** | (2006.01) |

(52) U.S. Cl.
CPC ..... *H04R 9/06* (2013.01); *H04R 7/127* (2013.01); *H04R 7/18* (2013.01); *H04R 9/025* (2013.01); *H04R 31/006* (2013.01); *H04R 2400/11* (2013.01)

(58) Field of Classification Search
CPC combination set(s) only.
See application file for complete search history.

(56) References Cited

U.S. PATENT DOCUMENTS 10,250,989 B1 * 4/2019 Xiao ..... H04R 31/003

FOREIGN PATENT DOCUMENTS

WO WO2013123777 * 10/2012 ..... H04R 9/025

* cited by examiner

*Primary Examiner* — Amir H Etesam
(74) *Attorney, Agent, or Firm* — W&G Law Group LLP

(57) ABSTRACT

A speaker module and a manufacturing method thereof is provided in present invention. The speaker module includes a frame, a magnetic circuit system and a vibration system. The vibration system has a vibrating diaphragm and a voice coil. The magnetic circuit system includes a magnet and an upper magnetic plate arranged on the magnet. The speaker module further includes flexible circuit boards electrically connected with the voice coil. The upper magnetic plate and the flexible circuit boards are integrally injection molded in the frame. By virtue of the configuration described in the present invention, the connection between the frame and the magnetic circuit system is precise and stable.

7 Claims, 4 Drawing Sheets

SPEAKER MODULE AND METHOD FOR MANUFACTURING SAME

FIELD OF THE PRESENT DISCLOSURE

The invention relates to the field of electroacoustic transducers, in particular to a speaker module and a manufacturing method thereof.

DESCRIPTION OF RELATED ART

The number of smart mobile devices is rising with the advent of the mobile internet era. Mobile phones are undoubtedly the most common and portable mobile terminal devices among many mobile devices. At present, mobile phones have extremely diverse functions, one of which is the high-quality music function, and the speaker in the mobile phone is one of the necessary conditions to realize this high-quality music function.

A related speaker module usually comprises a frame, a cover, a vibration system accommodated in the frame, and a magnetic circuit system that drives the vibration of the vibration system. The vibration system usually comprises a vibrating diaphragm and a voice coil that drives the vibrating diaphragm. The magnetic circuit system generally comprises a magnet and an upper magnetic plate arranged to the magnet surface with glue; flexible circuit boards are usually arranged to realize the electrical connection of the voice coil. The flexible circuit board and the upper magnetic plate are integrally injection moduled into the frame. However, in the related art, it is difficult to guarantee accuracy and reliability during injection moduling.

Therefore, it is necessary to provide an improved speaker module and a method for manufacturing the speaker module to solve the problems mentioned above.

SUMMARY OF THE PRESENT INVENTION

One of the major objects of the present invention is to provide a speaker module has a reasonably large lifetime.

In order to achieve the object mention above, the present invention discloses a speaker module comprises a frame having an accommodation space enclosed by a side wall, a magnetic circuit system accommodated in the frame, including a magnet and an upper magnetic plate attached on the magnet; and a vibration system accommodated in the frame, including a vibrating diaphragm and a voice coil for driving the vibrating diaphragm. At least one flexible circuit board electrically connected with the voice coil; wherein the upper magnetic plate and the flexible circuit board are integrally injection molded in the frame Further, at least one flexible circuit board electrically connected with the voice coil; wherein the upper magnetic plate and the flexible circuit board are integrally injection molded in the frame.

Further, the flexible circuit board comprises an inner ring connected to the voice coil, an outer ring integrally injection-molded with the frame, and a connection ring connecting the inner ring and the outer ring; the inner ring is fixedly connected to the voice coil.

Further, the side wall comprises an upper surface close to the vibrating diaphragm, a lower surface far from the vibrating diaphragm, and an inner edge and an outer edge connecting the upper surface and the lower surface; the flexible circuit boards and the upper magnetic plate are arranged on a lower surface of the side wall.

Further, the frame is a long strip shaped structure, the upper magnetic plate is disposed along two edges of the frame parallel to a long axis of the frame, the flexible circuit board is disposed along two edges of the frame parallel to a short axis of the frame.

Further, the upper magnetic plate comprises a main body and a bending part bending and extending from both sides of the main body; the bending part extends and is integrally injection molded into the frame.

Further, the vibrating diaphragm comprises a centrally positioned dome and a suspension surrounding the dome; the speaker module further includes a second vibrating diaphragm denting in a direction away from the vibrating diaphragm and attached to the flexible circuit board on a side away from the vibrating diaphragm.

In order to achieve the object mention above, the present invention further discloses a method for manufacturing the speaker module as described above, comprising steps of: Step S1: providing a frame injection module, a pair of first molding materials and a pair of second molding materials; wherein the first molding material comprises an upper magnetic plate and a first injection gear connected to the upper magnetic plate; the second molding material comprises at least one flexible circuit board and a second injection gear connected to the flexible circuit boards; Step S2: positioning the first molding material and the second molding material into the frame injection module respectively; wherein the frame injection module includes a positioning pillar; the first injection gear and the second injection gear include positioning holes cooperating with the guiding pillar; for precisely positioning the first molding material and the second molding material with the frame injection module; Step S3: closing the frame injection module and injecting plastic material into the module for molding; Step S4: opening the module and taking out a semi-finished frame, cutting off the first injection gear and the second injection gear for obtaining a finished frame; Step S5: assembling a vibration system and a magnetic circuit system with the frame for obtaining the speaker module The speaker module comprises a frame having an accommodation space, and a magnetic circuit system and a vibration system accommodated in the frame. The vibration system comprises a vibrating diaphragm and a voice coil that drives the vibration of the vibrating diaphragm. The frame comprises a side wall enclosing an accommodation space. The magnetic circuit system comprises a magnet and an upper magnetic plate arranged on the magnet with glue. The speaker module further comprises at least one flexible circuit board electrically connected with the voice coil. The upper magnetic plate and the flexible circuit board are integrally injection molded in the frame. The speaker module and the manufacturing method thereof can be used for accurate positioning and for effectively solving the problem of fixing the upper magnetic plate and the flexible circuit boards, and negative impact to the reliability of product because of falling can be prevented.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
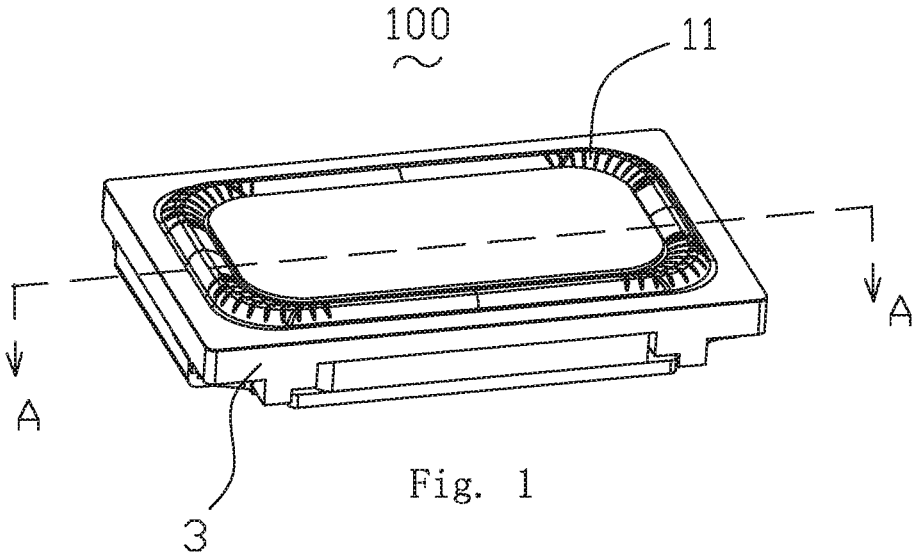
FIG. 1 is an isometric view of a speaker module in accordance with an exemplary embodiment of the present invention.
Figure 2:
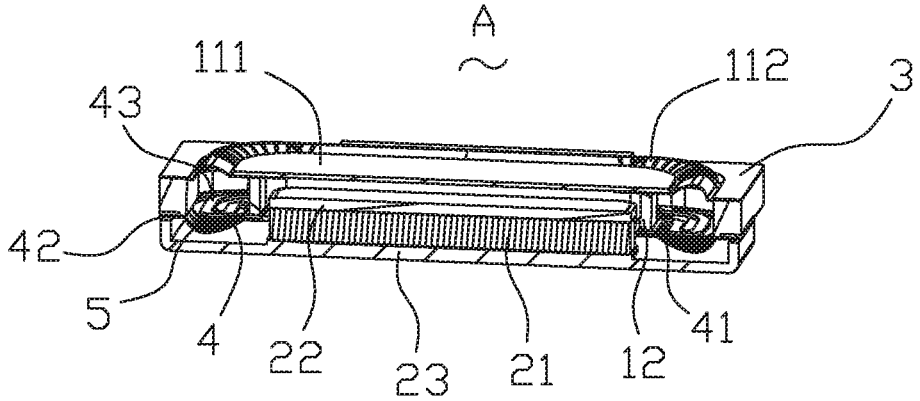
FIG. 2 is a cross-sectional view of the speaker module taken along line A-A in FIG. 1.
Figure 3:
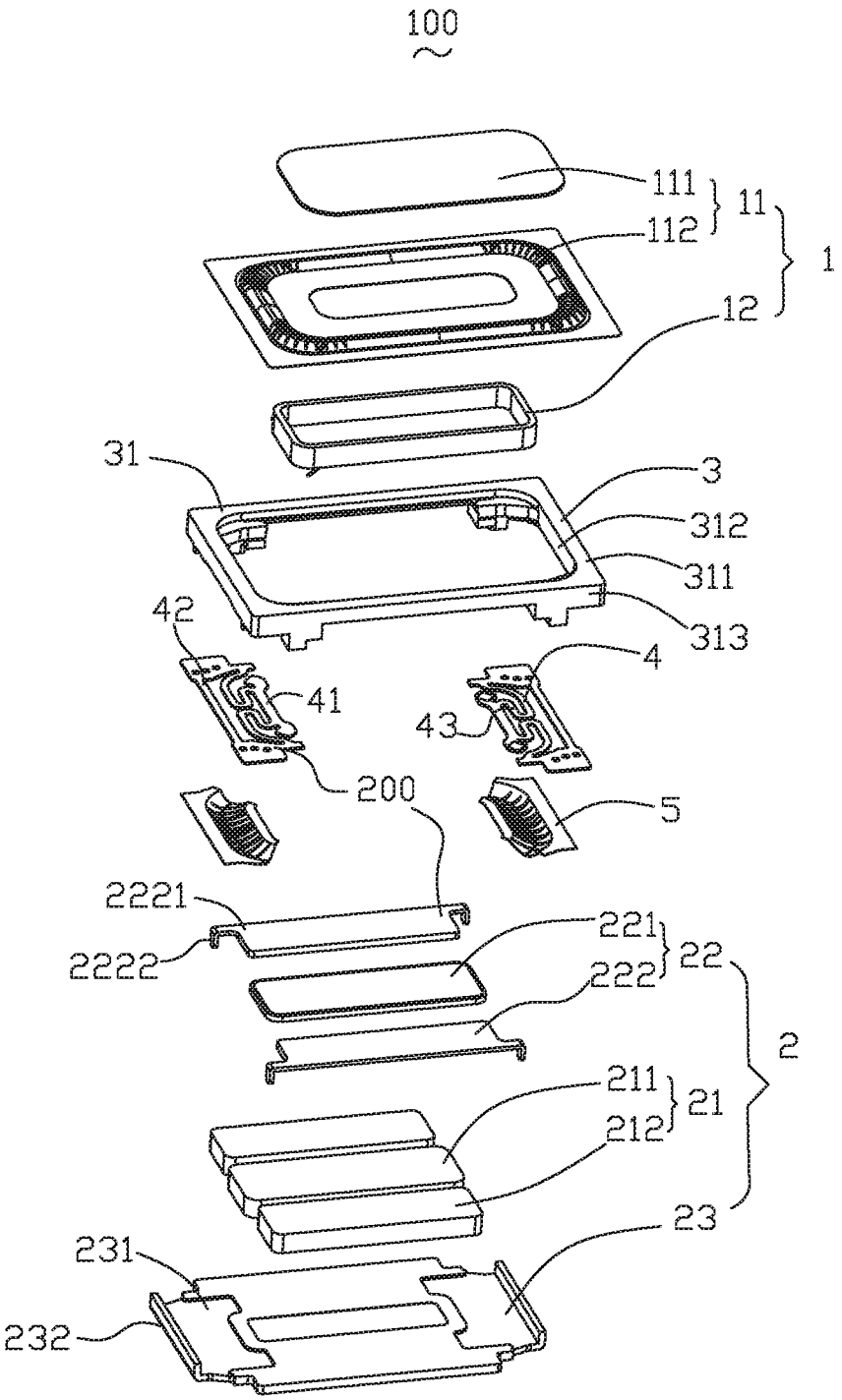
FIG. 3 is an exploded view of the speaker module in FIG. 1.

As shown in FIGS. 1-3, the present invention provides an injection module which is applied to a speaker module and a speaker module 100 which is assembled through the injection module.

The present invention provides a speaker module 100, which comprises a vibration system 1, a magnetic circuit system 2, and a frame 3 that accommodates and fixes the vibration system 1 and the magnetic circuit system 2 therein.

The vibration system 1 comprises a vibrating diaphragm 11 and a voice coil 12 that drives the vibration of the vibrating diaphragm 11. The voice coil 12 is made of wound voice coil lead. The vibrating diaphragm 11 comprises a dome 111 and a suspension 112 surrounding the dome 111. In this embodiment, the dome 111 and the suspension 112 are split structures, and the dome 111 is arranged on top of the suspension 112 with glue. An upper surface of the voice coil 12 abuts against a bottom of the suspension 112. Of course, in alternative embodiments, the dome 111 can also be arranged at the bottom of suspension, and the dome 111 and the suspension 112 can also be integrated structure, both of which can be implemented.

The frame 3 comprises a side wall 31 that encloses an accommodation space. The side wall 31 comprises an upper surface 311, a lower surface opposite to the upper surface 311, and an inner edge 312 and an outer edge 313 connecting the upper surface 311 to the lower surface. The vibrating diaphragm 1 is attached to the upper surface 311 of the side wall 31 by glue.

As shown in FIG. 3, the speaker module 100 of the present invention further comprises at least one flexible circuit board 4 provided at the bottom of the voice coil 12 for elastically supporting the vibration system and electrically connected to the voice coil 12. In this embodiment, the flexible circuit board 4 is integrally injection-molded and pressed by the injection module of the present invention. The flexible circuit board 4 comprises an inner ring 41 that supports the voice coil 12, an outer ring 42 that is integrally molded with the frame 3, and a connection ring 43 that connects the inner ring 41 and the outer ring 42. Further, inner ring 41 is fixed and connected to voice coil 12. Specifically, in this embodiment, two flexible circuit boards 4 are respectively arranged on both sides of the voice coil 12.

The magnetic circuit system 2 comprises a magnet 21, a magnetic conductive plate 22 arranged on the magnet 21 with glue, and a magnetic yoke 23 accommodating the magnet 21 and the magnetic conductive plate 22. The magnet 21 comprises a main magnet 211 positioned in the center and an auxiliary magnet 212 surrounding the main magnet 211. The magnetic conductive plate 22 comprises a pole plate 221 arranged on the surface of the main magnet 211 with glue and an upper magnetic plate 222 arranged to the surface of the auxiliary magnet 212 with glue. In this embodiment, the main magnet 211 is a rectangular permanent magnet, and is arranged in the center of the magnetic yoke 23. Two auxiliary magnets 212, are long strip shaped magnets arranged on both sides of main magnet 211. Correspondingly, two upper magnetic plates are arranged on both sides of the speaker module. The upper magnetic plate 222 is integrally molded on the frame 3. Specifically, the upper magnetic plate 222 comprises a main body 2221 and a bending part 2222 bending and extending from the body 2221 to both sides, and the bending part 2222 is extended and integrally injection-molded into the frame 3. Specifically, in this embodiment, the upper magnetic plate 222 is integrally injection-molded and pressed by the injection module of the present invention. The magnetic conductive plate 22 is made of magnetic conductive material and is arranged to the surface of magnet 21 with glue for conducting magnetic field and convergence of the magnetic field to improve the magnetic induction performance of the product. Specifically, the magnetic yoke 23 comprises a bottom plate 231 and a side plate 232 bent and extended from the bottom plate 231. A magnetic gap is formed between the main magnet 211 and the auxiliary magnet 212. The voice coil 12 is inserted into the magnetic gap, and is forced to move in the magnetic gap during the energization process, which drives the vibrating diaphragm 11 to vibrate along the vertical direction.

In this embodiment, both the upper magnetic plate 222 and the flexible circuit board 4 are integrally injection-molded into the frame by using the injection module of the present invention, and are arranged on the lower surface of the side wall 31 of the frame 3. In this embodiment, the frame 3 is a long strip shaped structure, the upper magnetic plate 222 is arranged along two long axis edge directions of frame 3, and the flexible circuit board 4 is arranged in the two short axis edge directions of frame 3.

Further, a second vibrating diaphragm 5 denting in a direction away from the vibrating diaphragm 11 is provided on surfaces at one side of the flexible circuit boards 4 away from the vibrating diaphragm 11. The side plate 232 and the side wall 31 clamps an outer ring 41 that fix the flexible circuit board 4 and the second vibrating diaphragm 5. In this way the vibration stability of the vibration system can be further improved.

Figure 4:
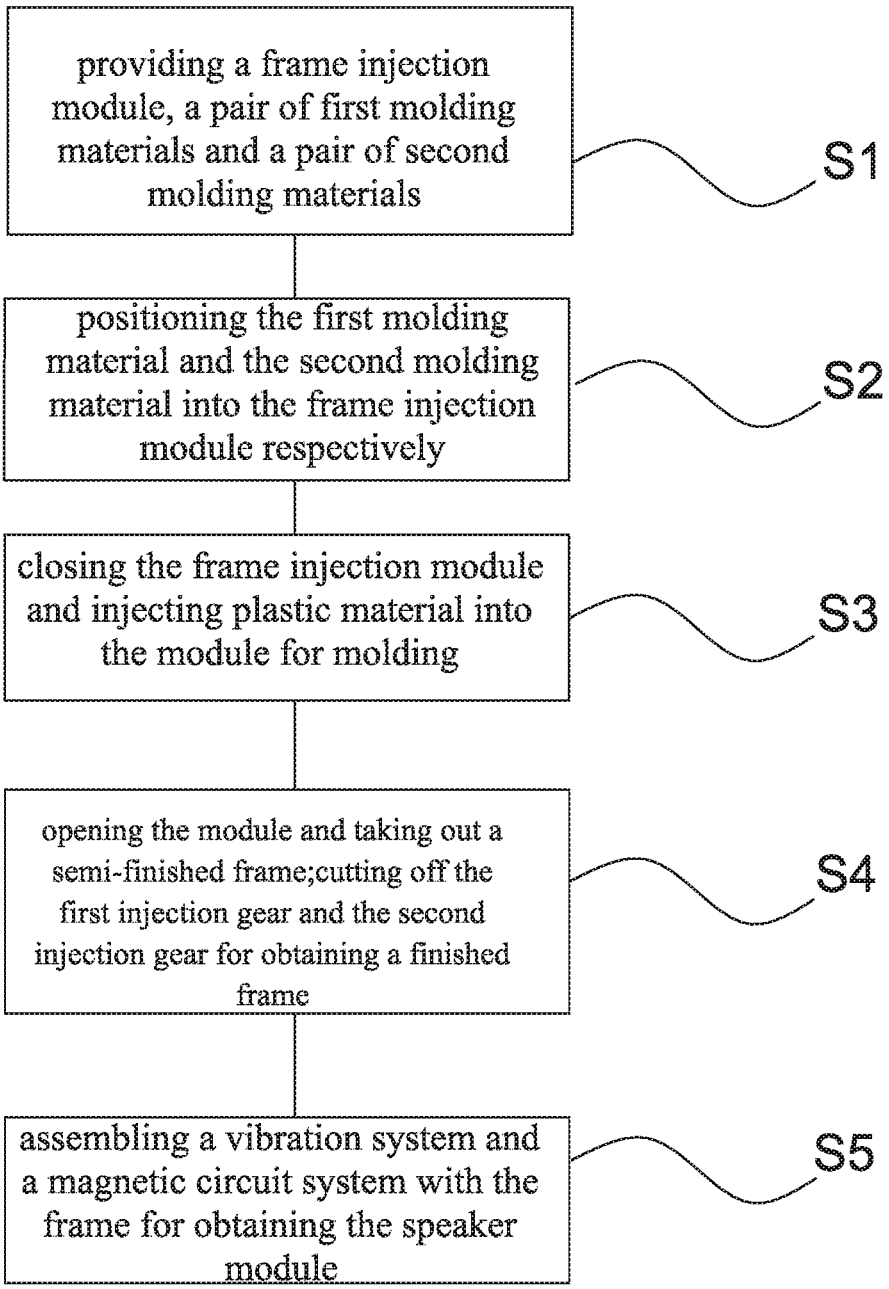
FIG. 4 is a flow chart of a method for manufacturing the speaker module in FIG. 1.
Figure 5:
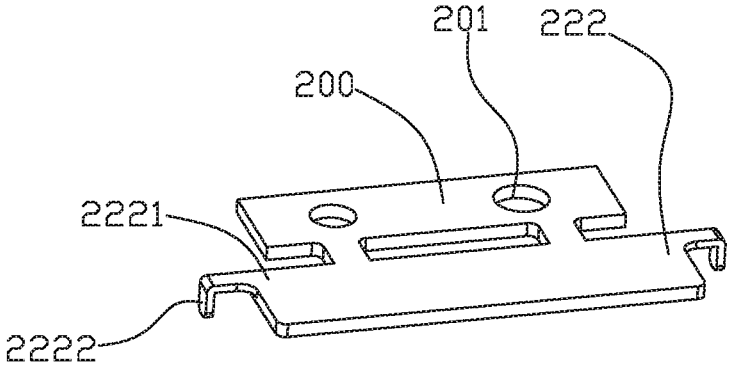
FIG. 5 is an illustration of a first molding material used in the manufacturing method.
Figure 6:
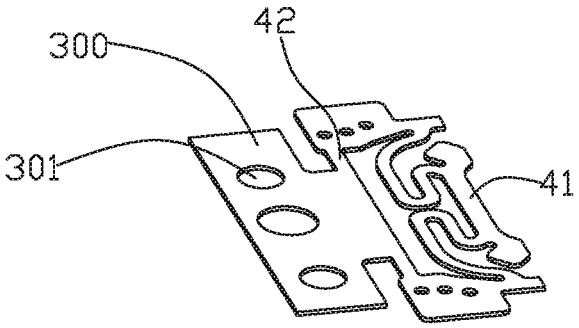
FIG. 6 is an illustration of a second molding material used in the manufacturing method.

As shown in FIGS. 4-6, the present invention further provides a method for manufacturing the speaker module, which comprises the following steps:

Step S1: providing a frame injection module, a first molding material and a second molding material. The first molding material comprises an upper magnetic plate 222 and a first injection gear 200 connected to the upper magnetic plate 222, and the second molding material comprises the flexible circuit board 4 and a second injection gear 300 connected to the flexible circuit boards 4. Two first molding material and second molding material, are respectively arranged corresponding to the positions of the upper magnetic plate and flexible circuit boards of the speaker module;

Step S2: putting the first and second molding materials into the frame injection module. The frame injection module includes a plurality of guiding pillars for positioning. The first injection gear 200 and the second injection gear 300 includes positioning holes for cooperating with the positioning pillars. By virtue of the positioning holes and the positioning pillars, the first molding material and the second molding material are precisely assembled with the frame injection module. The positioning holes comprise a first positioning hole 201 provided on the first injection gear 200 and a second positioning hole 301 provided on the second injection gear 300;

Step S3: closing the mold and injecting plastic material for molding. The plastic materials are selected according to actual needs, for example, any one of polyethylene (PE), polypropylene (PP), styrene-butadiene-acrylonitrile copolymer (ABS) polyvinyl chloride (PVC);

Step S4: opening the mold to take out the semi-finished frame, cutting off the first injection gear 200 and the second injection gear 300 to finish the frame 3;

Step S5: assembling the vibration system 1 and the magnetic circuit system 2 with the frame 3 to form the speaker module. Specifically, the step further includes steps of gluing the voice coil and spot welding of the voice coil wire, gluing the second vibrating diaphragm on the bottom of the voice coil, flipping frame 2 and gluing it with the vibrating diaphragm, and installing the magnetic circuit system after flipping again to complete the assembly of the product. Accordingly, the speaker module is manufactured.

A speaker module and a manufacturing method thereof is provided in present invention. The speaker module comprises a frame having an accommodation space, and a magnetic circuit system and a vibration system accommodated in the frame. The vibration system comprises a vibrating diaphragm and a voice coil that drives the vibration of the vibrating diaphragm. The frame comprises a side wall enclosing an accommodation space. The magnetic circuit system comprises a magnet and an upper magnetic plate arranged on the magnet with glue. The speaker module further comprises at least one flexible circuit board electrically connected with the voice coil. The upper magnetic plate and the flexible circuit board are integrally injection molded in the frame. The speaker module and the manufacturing method thereof can be used for accurate positioning and for effectively solving the problem of fixing the upper magnetic plate and the flexible circuit boards, and negative impact to the reliability of product because of falling can be prevented.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker module comprising:

a frame having an accommodation space enclosed by a side wall;

a magnetic circuit system accommodated in the frame, including a magnet and an upper magnetic plate attached on the magnet;

a vibration system accommodated in the frame, including a vibrating diaphragm and a voice coil for driving the vibrating diaphragm; and at least one flexible circuit board electrically connected with the voice coil; wherein the upper magnetic plate and the flexible circuit board are integrally injection molded in the frame, the vibrating diaphragm comprises a centrally positioned dome and a suspension surrounding the dome; the speaker module further includes a second vibrating diaphragm denting in a direction away from the vibrating diaphragm and attached to the flexible circuit board on a side away from the vibrating diaphragm.

2. The speaker module as described in claim 1 comprising two flexible circuit boards disposed on both sides of the voice coil.

3. The speaker module as described in claim 1, wherein the flexible circuit board comprises an inner ring connected to the voice coil, an outer ring integrally injection-molded with the frame, and a connection ring connecting the inner ring and the outer ring; the inner ring is fixedly connected to the voice coil.

4. The speaker module as described in claim 1, wherein the side wall comprises an upper surface close to the vibrating diaphragm, a lower surface far from the vibrating diaphragm, and an inner edge and an outer edge connecting the upper surface and the lower surface; the flexible circuit boards and the upper magnetic plate are arranged on a lower surface of the side wall.

5. The speaker module as described in claim 1, wherein the frame is a long strip shaped structure, the upper magnetic plate is disposed along two edges of the frame parallel to a long axis of the frame, the flexible circuit board is disposed along two edges of the frame parallel to a short axis of the frame.

6. The speaker module as described in claim 4, wherein the upper magnetic plate comprises a main body and a bending part bending and extending from both sides of the main body; the bending part extends and is integrally injection molded into the frame.

7. A method for manufacturing the speaker module as described in claim 1, comprising steps of:

Step S1: providing a frame injection module, a pair of first molding materials and a pair of second molding materials; wherein the first molding material comprises an upper magnetic plate and a first injection gear connected to the upper magnetic plate; the second molding material comprises at least one flexible circuit board and a second injection gear connected to the flexible circuit boards;

Step S2: positioning the first molding material and the second molding material into the frame injection module respectively; wherein the frame injection module includes a positioning pillar; the first injection gear and the second injection gear include positioning holes cooperating with the guiding pillar; for precisely positioning the first molding material and the second molding material with the frame injection module;

Step S3: closing the frame injection module and injecting plastic material into the module for molding;

Step S4: opening the module and taking out a semi-finished frame, cutting off the first injection gear and the second injection gear for obtaining a finished frame;

Step S5: assembling a vibration system and a magnetic circuit system with the frame for obtaining the speaker module.

* * * * *